United States Patent [19]

Mosca

[11] Patent Number: 4,488,316

[45] Date of Patent: Dec. 18, 1984

[54] MISTLETOE SUPPORTING HEADBAND

[76] Inventor: Ronald J. Mosca, 4551 W. Sanna St., Glendale, Ariz. 85302

[21] Appl. No.: 542,739

[22] Filed: Oct. 17, 1983

[51] Int. Cl.[3] ..... A42B 0/00

[52] U.S. Cl. ..... 2/171; 2/174; 2/185 R; 2/186; 2/209.2

[58] Field of Search ..... 2/171, 174, 185, 186, 2/244, 209.1, 209.2

[56] References Cited

U.S. PATENT DOCUMENTS

| | | | |
|---|---|---|---|
| 834,900 | 11/1906 | Glerum | 2/186 R |
| 933,473 | 9/1909 | Leopold | 2/185 |
| 1,008,109 | 11/1911 | Brickerton | 2/185 R |
| 1,024,105 | 4/1912 | Shafer | 2/186 |
| 2,566,950 | 2/1948 | Miller et al. | 2/171 |
| 2,679,711 | 6/1951 | Learnard | 2/185 R |
| 3,098,316 | 10/1959 | McCarthy | 2/185 R |
| 3,179,954 | 4/1965 | Weitznek | 2/186 |
| 3,216,149 | 11/1965 | Briese | 2/185 R |

FOREIGN PATENT DOCUMENTS

| | | | |
|---|---|---|---|
| 1027151 | 3/1953 | France | 2/171 |

OTHER PUBLICATIONS

Gershman, *Journal of American Medical Association,* vol. 168, No. 7, "Self-Adhering Nylon Tapes", Oct. 19, 1958, p. 980.

*Primary Examiner*—Werner H. Schroeder
*Assistant Examiner*—Mary A. Ellis

[57] ABSTRACT

This novel and unique headband device serves to support a fresh piece of mistletoe in front of its wearer's head. Primarily, it consists of a strip of material, which is suitably fastened to the head of the wearer, and it also includes a fork member, having an opening for receiving the mistletoe, which is disposed of after its use. The headband may also be used for supporting other decorative or novelty items.

2 Claims, 5 Drawing Figures

FIG. 1
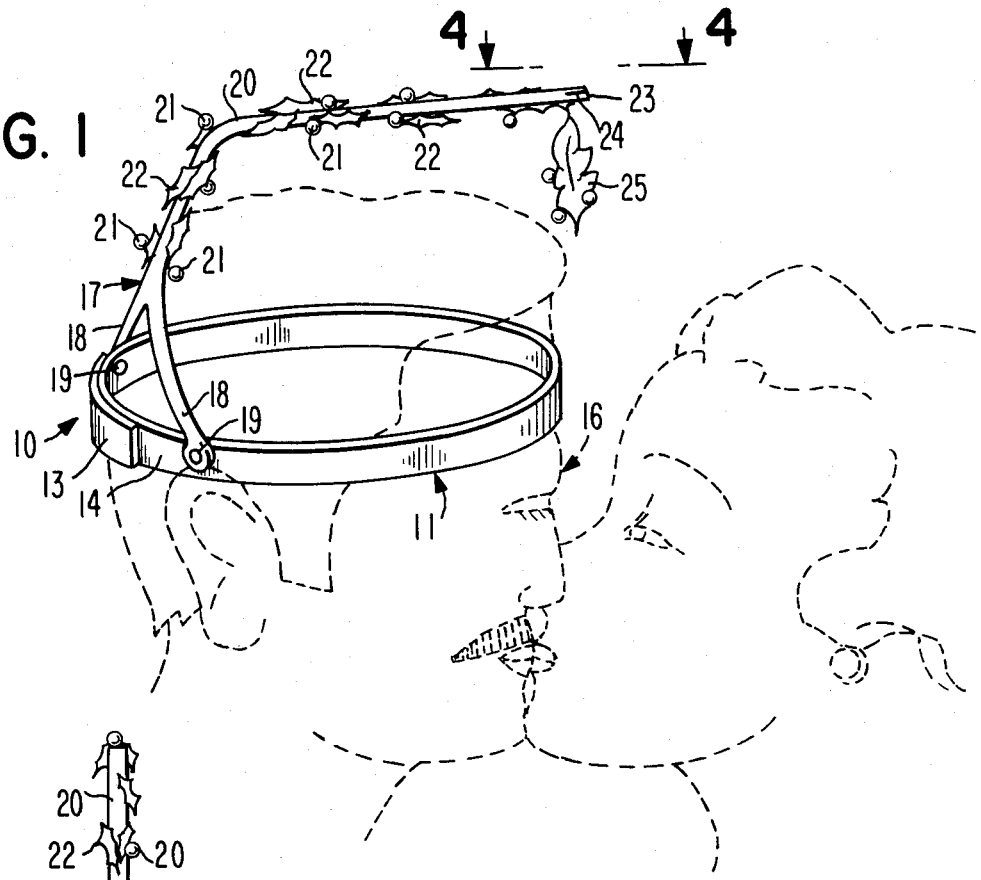
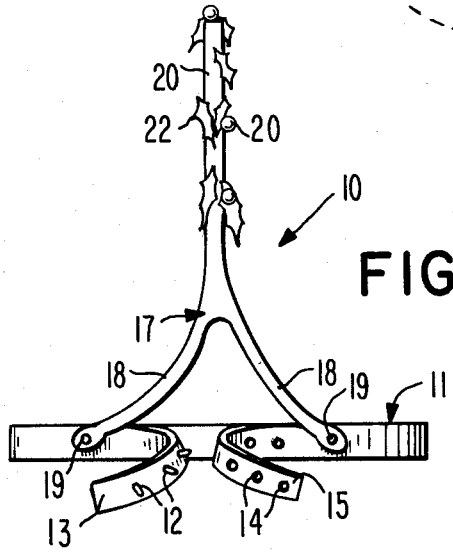
FIG. 2
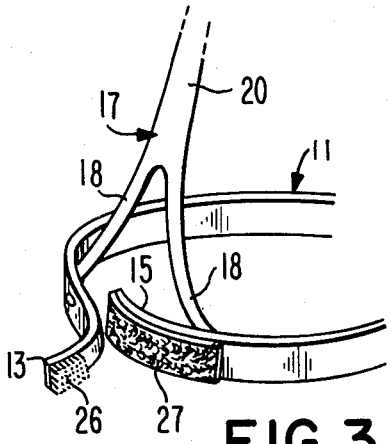
FIG. 3
FIG. 4
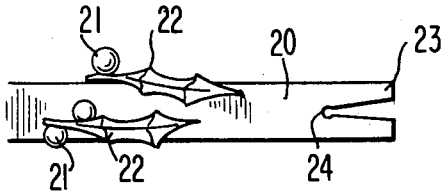
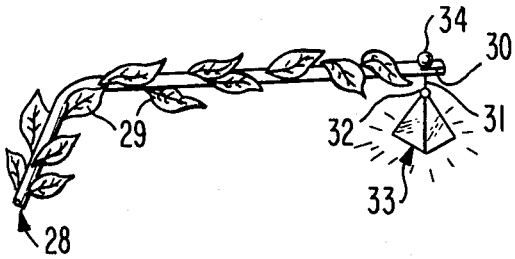
FIG. 5

MISTLETOE SUPPORTING HEADBAND

This invention relates to headbands, and more particularly, to a mistletoe supporting headband.

The principal object of this invention is to provide a mistletoe supporting headband, which will be unique and novel, and will be worn by its users at Christmas parties, etc.

Another object of this invention is to provide a mistletoe supporting headband, which will be worn on the head of the users, to display a piece of mistletoe above the forehead of its users, so as to entice a person or persons to kiss the wearer, as is an old Christmas custom, with the exception, that formerly, mistletoe was hung in such areas as a doorway, and if a person should happen to stand in such a doorway, another person could take the liberty of kissing the one in the doorway.

Another object of this invention is to provide a mistletoe supporting headband, which will include a fork-like portion, having holly berries and leaves attached thereto, for decorative purposes.

A further object of this invention is to provide a mistletoe supporting headband, which will have a cut-out in the fork-like member, for removably receiving a piece of fresh mistletoe, that will depend from the area just above and in front of the forehead of the wearer.

Other objects are to provide a mistletoe supporting headband, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the present invention, shown being worn by its user, the kissing partners, being shown in phantom;

FIG. 2 is a rear elevational view of the invention, shown removed from the wearer;

FIG. 3 is a fragmentary view of FIG. 1, showing the band portion open, and illustrating a modified form of fastening the ends of the band together;

FIG. 4 is an enlarged view, taken along the line 4—4 of FIG. 1, showing the mistletoe removed therefrom, and FIG. 5 is a fragmentary perspective view, illustrating a modified form of fork for the invention.

Accordingly, a device 10 is shown to include a headband 11, having a plurality of spaced nipples 12 on the inside face of one end 13, which are removably received within similarly spaced openings 14, through the opposite end 15 of headband 11, so as to enable headband 11 to be adjustably secured to the wearer's head 16. A fork member 17 is provided, and its pair of tines 18 are fixedly secured to the rear portion of headband 11, by suitable fasteners 19. The shank 20 of fork 17 extends above the head 16 of the wearer, and includes a plurality of holly berries 21 and holly leaves 22, which are fixedly secured thereto, in a suitable manner. The end

23 of shank 20 includes a cut-out opening 24 therein, which removably receives a fresh piece of mistletoe 25, and the opening 24 is tapered in configuration, so as to engage frictionally the mistletoe 25, which depends downward and above the head 16 of the wearer.

In use, headband 11 is fastened to the head 16, by pressing the nipples 12 into the desired openings 14, after the fresh mistletoe 25 has been forced into the opening 24 of the shank 20 of the fork 17. Removing headband 11 is accomplished by disengaging nipples 12 from their respective openings 14, and the used mistletoe is pulled from opening 24, and disposed of.

Referring now to FIG. 3, a pair of mating hook and loop strips 26 and 27 are fixedly secured to the ends 13 and 15 of headband 11, and are common in the art, and serve to secure headband 11 adjustably to the head 16 of the wearer, instead of the nipple 12 and opening 14 means, which are heretofore described.

In use, the modified fastening means, mentioned above, are pressed together to fasten ends 13 and 15, and are pulled apart from each other to unfasten ends 13 and 15.

Looking now at FIG. 5 of the drawing, a modified form of fork 28, for headband 11, is shown to include a plurality of decorative leaves 29, which are fixedly secured to the outer periphery thereof, and a cut-out opening 30, in the end of fork 28, is similar to opening 24 of fork 17, heretofore described, which frictionally receives cord or wire 31, that is fastened to an eye 32, fixedly secured to the top of a crystal pyramid pendant 33, or other exotic piece of jewelry, which reflects light in color, and serves to draw attention to the wearer, in a hypnotic sense. A bead 34 is also fixedly secured to the opposite end of cord or wire 31, so as to prevent the pyramid 33 from falling from fork 28.

In use, fork 28 functions in the same manner as was heretofore described of fork 17, with the exception, that the pyramid 33 acts as a pendulum, and reflects light in various colors of the color spectrum, as it sways by the movement of its wearer.

While various changes may be made in the detail construction, it is understood that such changes will be within the spirit and scope of the present invention as is defined by the appended claims.

I claim:

1. A mistletoe supporting headband, comprising, in combination, an open band for adjustably fitting around a forehead from the rear of a wearer's head, a cantilevered boom affixed upon the rear of said band and extending forwardly therefrom above said wearer's head, to a point above said wearer's face, a rear end of said boom comprising a bifurcated portion mounted upon sidewardly spreadable rear ends of said band, and a replaceable mistletoe sprig mounted on a forward end of said boom.

2. The combination as set forth in claim 1, wherein said boom is decorated to represent a growing leafy branch having said mistletoe sprig at said end thereof.

* * * * *